US005207349A

United States Patent [19]

Kringel

[11] Patent Number: 5,207,349

[45] Date of Patent: May 4, 1993

[54] COUPON DISPENSER

[75] Inventor: George N. Kringel, Westport, Conn.

[73] Assignee: Actmedia, Inc., Norwalk, Conn.

[21] Appl. No.: 791,556

[22] Filed: Nov. 14, 1991

Related U.S. Application Data

[62] Division of Ser. No. 556,906, Jul. 20, 1990, Pat. No. 5,083,765.

[51] Int. Cl.[5] ..... B65B 59/00

[52] U.S. Cl. ..... 221/15; 271/258

[58] Field of Search ..... 221/255, 15; 271/118, 271/126, 258, 13, 277

[56] References Cited

U.S. PATENT DOCUMENTS

| | | | |
|---|---|---|---|
| 1,055,639 | 3/1913 | Juengst | 271/118 |
| 3,545,742 | 12/1970 | Muller et al. | 271/258 |
| 3,936,041 | 2/1976 | Shiina et al. | 271/258 |
| 4,411,466 | 7/1984 | Uchida et al. | 271/126 |
| 4,548,397 | 10/1955 | Runzi | 271/126 |
| 4,565,361 | 1/1986 | Tanaka et al. | 271/258 |

FOREIGN PATENT DOCUMENTS

| | | | |
|---|---|---|---|
| 317923 | 12/1989 | Japan | 271/118 |

*Primary Examiner*—Robert P. Olszewski
*Assistant Examiner*—Kenneth Noland
*Attorney, Agent, or Firm*—St. Onge Steward Johnston & Reens

[57] ABSTRACT

A stand alone dispenser including an integral electrical power supply is provided for reliably dispensing individual sheets, such as coupons, from a stack. The dispenser comprises a clutch for preventing excessive pressure between the stack and a coupon remover to minimize current drain on the power supply. A stack advancer enables advancement of the stack, as necessary, whenever a coupon is dispensed through engagement by the clutch to the coupon remover. A control circuit includes delay and shutdown functions to limit excessive coupon removal, and a dispenser level indicator to discourage tampering or theft. The dispenser is mountable to store shelving or other point of purchase displays.

8 Claims, 12 Drawing Sheets

COUPON DISPENSER

This is a divisional of copending application Ser. No. 07/556,906 filed on Sep. 20, 1990 on Jul. 20, 1990, now U.S. Pat. No. 5,083,765.

FIELD OF THE INVENTION

This invention relates to a device for dispensing coupons or sheets from a stack. More specifically, this invention relates to a battery powered automatic coupon dispenser and a method for dispensing coupons in point of purchase promotions.

BACKGROUND ART

Article dispensers having a variety of features are known in the art. By way of example, U.S. Pat. No. 4,875,599 discloses a battery-powered business card dispenser. When a button is pressed, a timer is used to operate a motor for a fixed time necessary to dispense a card.

U.S. Pat. No. 4,026,436 discloses a time controllable cigarette dispenser which automatically dispenses cigarettes at preset time intervals after a dispensed cigarette has been removed from a dispensing tray by a user.

In addition to various other articles, prior art dispensers are also capable of dispensing single sheets (such as coupons) from a stack of sheets. Again by way of example, U.S. Pat. No. 4,919,412 discloses a single sheet draw-off system including a draw-off roller coupled to a pressure sensor. Stack pressure is adjusted based on the time required to draw off a single sheet. A predetermined range of forces needed to draw a single sheet off the stack is taught. A pressure plate is moved along a toothed guide rail to adjust stack pressure.

U.S. Pat. No. 4,475,732 discloses a sheet feeding device which senses the stack force between a feed member and the stack. The stack force may be adjusted by rotating the feed member about a pivot point. U.S. Pat. No. 4,039,181 discloses a coupon dispenser for dispensing a coupon into an open package as it passes along on a conveyor. Photo diodes count coupons as they are dispensed.

U.S. Pat. No. 4,717,043 discloses a coupon dispenser for use with a vending machine. Single coupons are separated from the stack and moved to a ready position. Once money is deposited in the machine, coupons are moved from the ready position to a dispensing position where they are held by nip rollers. U.S. Pat. No. 3,899,841 discloses a coupon display and clip for attaching to grocery shelf edging.

A disadvantage of prior art dispensers for point of purchase promotions is that they are not designed for low power consumption and thus are not efficiently operable with an integral power supply such as batteries. A further disadvantage of prior art coupon dispensers is that they provide virtually no protection against excessive coupon removal or "loading" by a single customer.

SUMMARY OF THE INVENTION

With a coupon dispenser in accordance with the invention, long term operation under battery power is achieved by reducing the power required to remove a coupon and regulate the movement of the coupon stack towards a coupon remover mechanism. Single coupon separation is reliably achieved. The coupon dispenser is made compact, easy to service and conveniently mounts to a variety of places such as price rails on grocery store shelves.

This is achieved with one coupon dispenser in accordance with the invention by employing a coupon stack advancer that moves the coupon stack towards a coupon remover mechanism. The latter is driven by a battery powered motor that applies a coupon take-off wheel in a yieldable manner against the lead coupon in the stack. The coupon remover mechanism also provides the drive, through a releasable coupling, for moving the coupon stack advancer.

Hence, as coupons are dispensed the stack is automatically also advanced. However, when stack pressure against the take-off wheel becomes excessive, the wheel and its assembly yields and at the same time further stack advancing is automatically interrupted by disengaging the drive via the releasable coupling. In this manner the pressure of the take-off wheel against the stack can be limited, thus reducing the torque required by the motor to remove the lead coupon and saving battery power.

The variety of papers that can be encountered for coupons and the amount of stickiness between coupons in the stack can greatly affect the power needed from the motor to remove a single coupon. Various techniques are thus further used to assure lead coupon separation the first being the use of a well-controlled low pressure applied to the top sheet as described for the take-off wheel. A second separation technique is used for underlying coupons that are fanned out as a result of the operation of the take-off wheel. This second feature involves a deflection wall placed at an angle to the discharge path followed by removed coupons. A third feature involves the use of a separating tab located on the deflection wall. Photo sensing of coupons to control their dispensing is done in an efficient low mechanical or electrical power requiring manner.

With these techniques a short burst of motor power assures a discharge of a single coupon, advance of the coupon stack without excessive stack pressure and a limited power drain or current drain on the battery for its prolonged operation before requiring its replacement.

A coupon dispenser of this invention can be made compact and yet capable of storing an adequate number of coupons. Controls are included to discourage excessive coupon removals, provide for visually flashing indications and warnings for low coupon level and low battery power level. A coupon dispenser of this invention can also operate in any orientation.

It is accordingly an object of the invention to provide a coupon dispenser for point of purchase promotions. It is another object of the invention to provide a coupon dispenser for limiting excessive coupon removing by a single customer. It is yet another object of the invention to provide a self-contained and powered coupon dispenser. It is still another object of the invention to provide a device for dispensing a single sheet such as a coupon from a stack of sheets with minimum power consumption. It is yet still another object of the invention to provide a device for preventing excessive pressure between a sheet remover and a stack of sheets such as coupons. It is a further object of the invention to provide a sheet dispenser that can be oriented in any direction, requires little power and can be operated electrically or with mechanical power.

The particular construction and operation of illustrative coupon dispensers in accordance with the invention will become apparent from the following detailed description when considered with reference to the accompanying drawings.

DETAILED DESCRIPTION OF THE INVENTION

Figure 1:
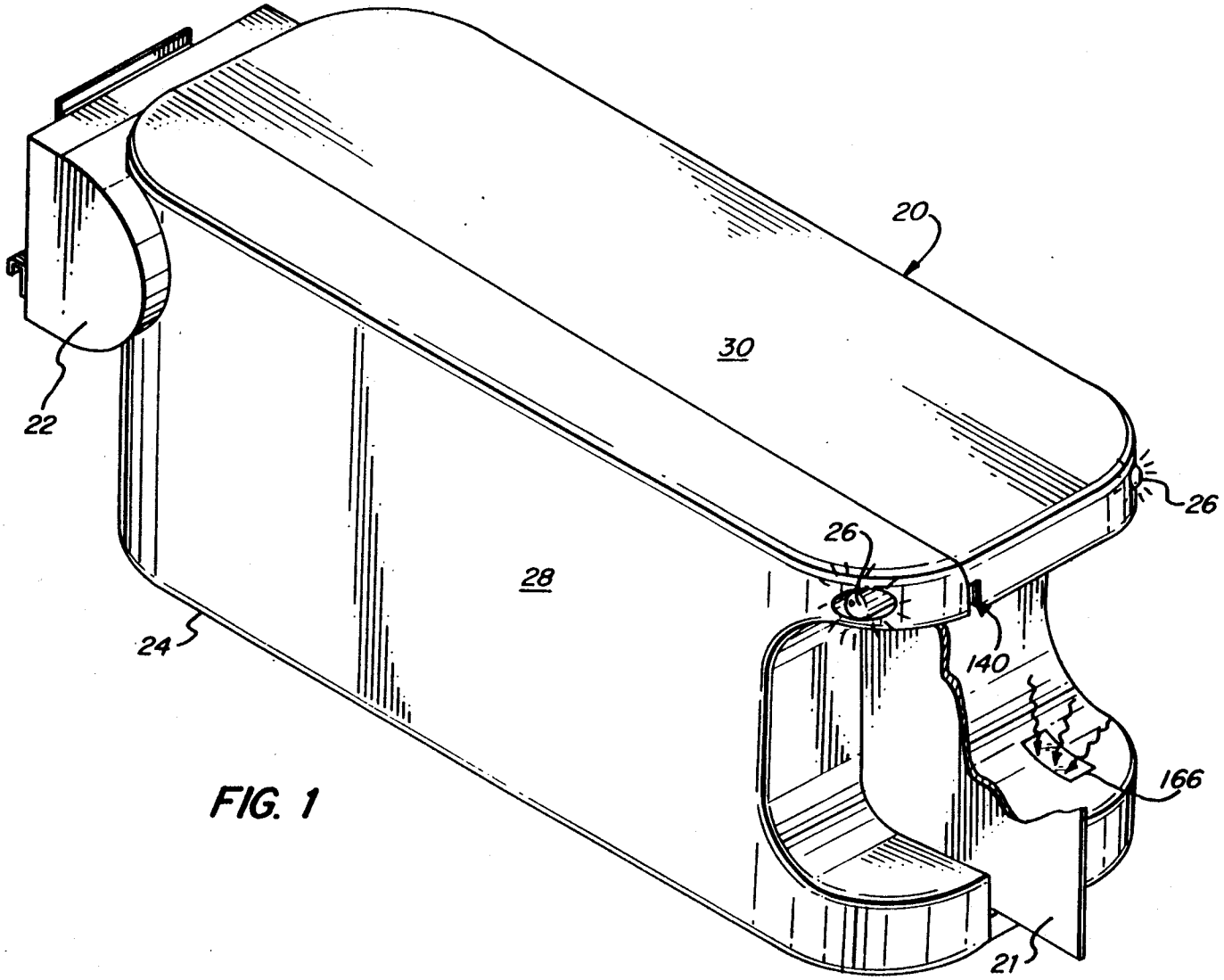
FIG. 1 is a front perspective view of a preferred embodiment of a coupon dispenser in accordance with this invention.

Referring to FIG. 1, a battery powered coupon dispenser 20 in accordance with the invention is shown for dispensing coupons such as 21. Although the invention is described herein as a coupon dispenser, it is understood that other sheet material may be dispensed as well. Coupons 21 are preferably partially dispensed from coupon dispenser 20 in order to minimize battery power drain. Complete coupon removal is then done either by a customer or initiated remotely or by mechanical means.

A mounting device 22 such as that described in copending U.S. patent application Ser. No. 07/311,743 entitled ADVERTISING DISPLAY MOUNTING DEVICE and assigned to the same assignee as of this invention is used to mount coupon dispenser 20 to grocery store shelving price rails (not shown), to other merchandise shelving, or at point of purchase displays. Mounting device 22 is designed to be relatively tamperproof in order to reduce the incidence of theft of the dispenser.

Coupon dispenser 20 includes an attractive housing 24 that may be attached as shown and thus longitudinally extend from mounting bracket 22 into a store aisle or the like to improve its visibility to store customers. Other orientations can be employed. Visibility of coupon dispenser 20 is further accentuated by brightly coloring the housing 24, or including two or more flashing lights 26.

Figure 3:
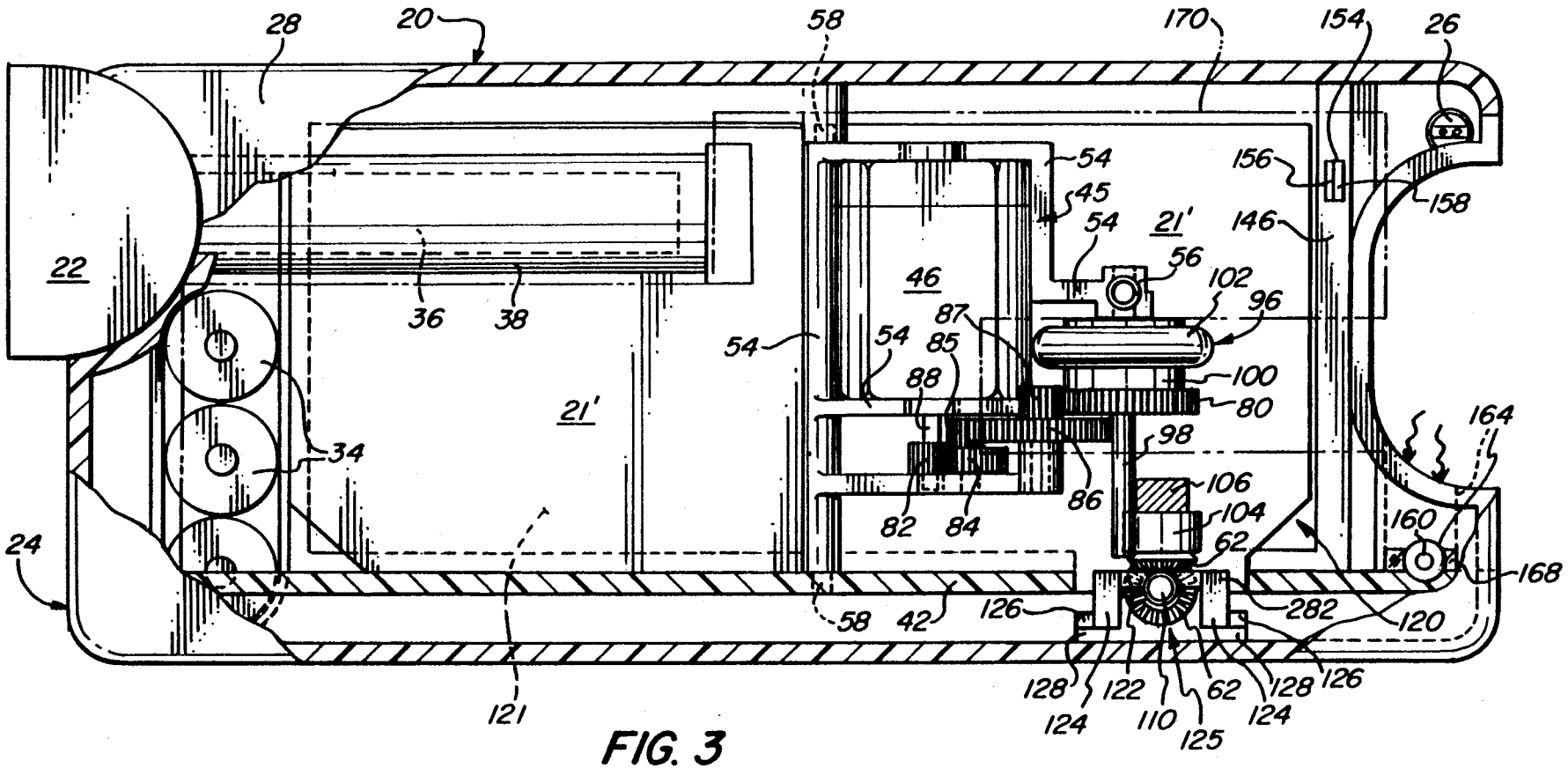
FIG. 3 is a side elevational view of the coupon dispenser of FIG. 1.
Figure 5:
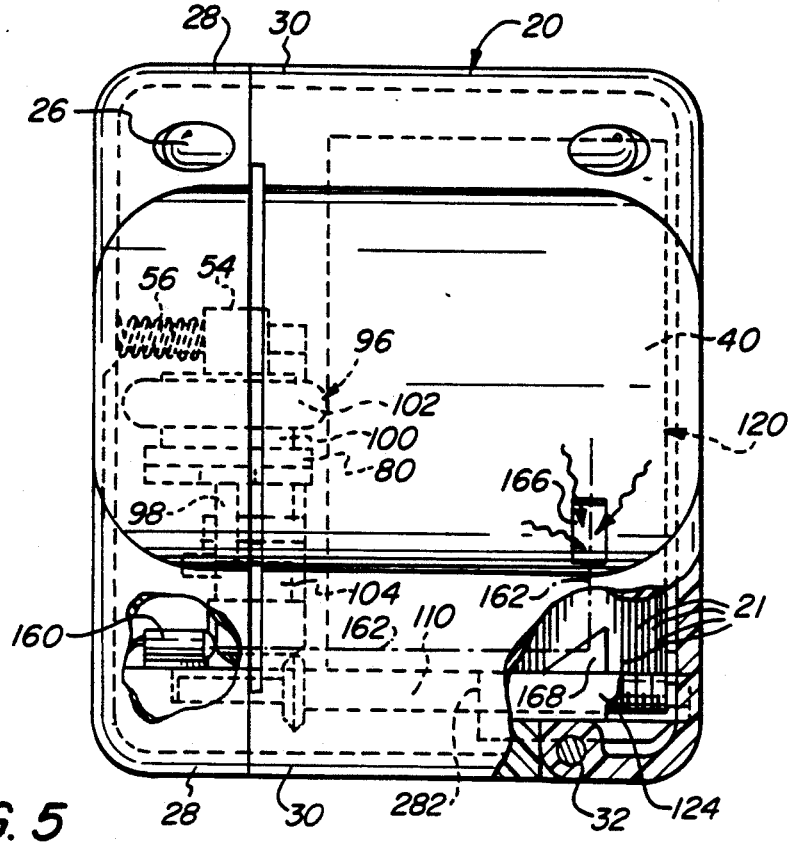
FIG. 5 is a front elevational view of the coupon dispenser of FIG. 1.

Housing 24 is separable into two hinged parts such as a control portion 28 and a hopper portion 30 which are connected by a hinge 32 (not shown in this view, see FIG. 5). Referring briefly to FIG. 3, mounting device 22 is relatively flexingly attached to housing 24 of coupon dispenser 20 with supporting rod 36 anchored in mounting device 22 which extends into a sleeve 38 integrally molded within control portion 28 of housing 24. By flexingly is meant that although securely attached, housing 24 may move with several degrees of freedom relative to mounting device 22 so that if housing 24 is bumped or the like by a customer or shopping cart it is unlikely either to cause injury, or to break away from mounting device 22.

Figure 2:
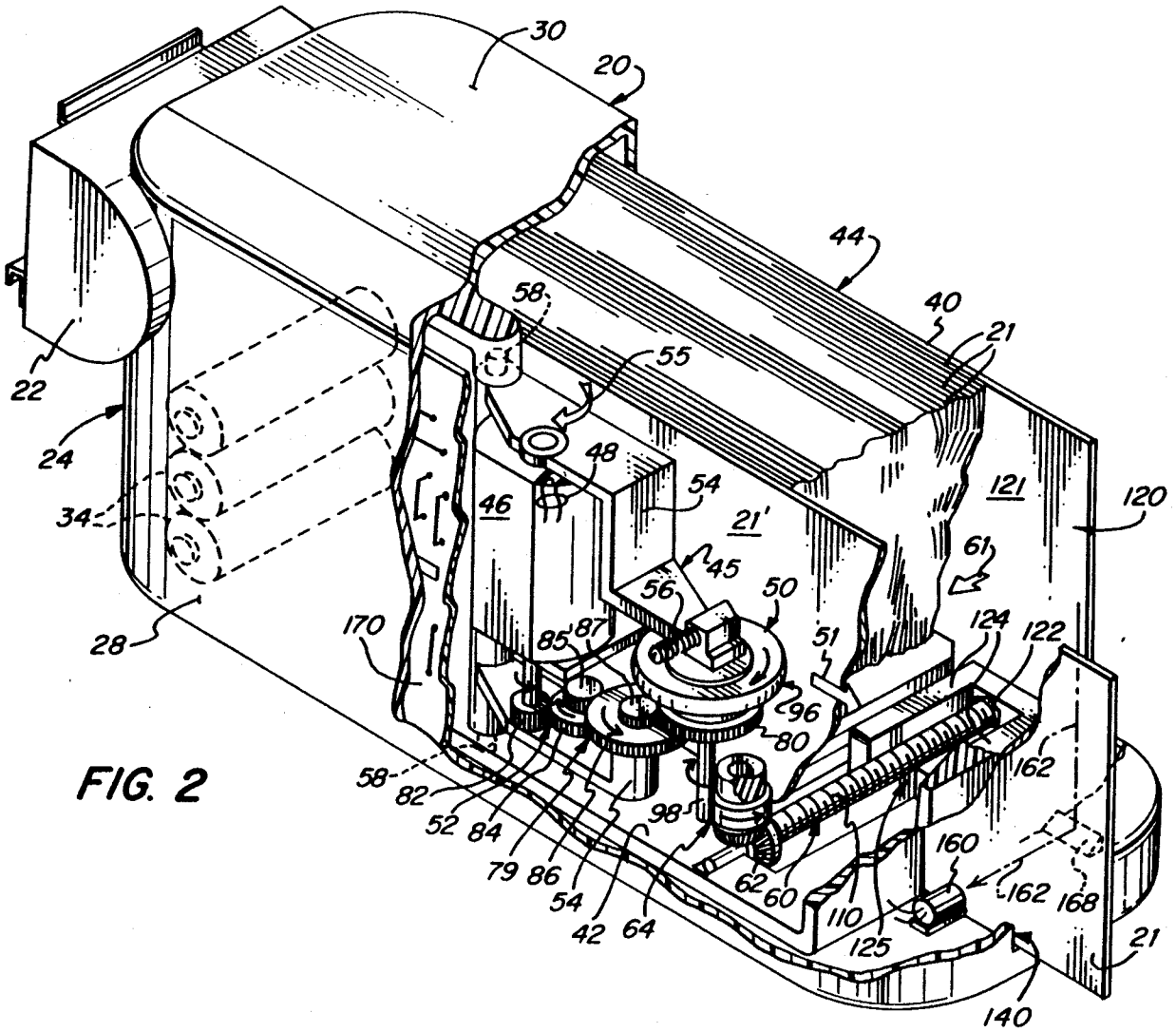
FIG. 2 is a partially cut away front perspective view of the coupon dispenser of FIG. 1.

Referring now to FIG. 2, a partial cut away from the perspective view of coupon dispenser 20 generally reveals its inner structure and workings. The majority of the interior volume of the housing is occupied by a coupon hopper 44 containing a stack 40 of coupons 21 supported on edge by a base 42 of housing 24.

The control part 28 of housing 24 includes a mechanism 45 used to remove the lead coupon 21' from the stack 40 and which also causes an advance of the stack 40. The mechanism 45 is driven by a motor 46 which is actuated with battery power applied via lines 48 by a control also powered by one or more batteries 34. Other self contained power sources, such as a spring motor or solar cells, may also be used. A coupon remover 50 in the form of a take-off wheel contacts a first outer coupon 21' of coupon stack 40 to dispense it along a discharge path. The coupon remover 50 is coupled to motor 46 by a gear train 52. Coupon remover 50 causes sliding removal of the first outer coupon 21' along a discharge path illustrated by arrow 51 (see also FIGS. 8A to 8D) with low current drain on batteries 34 and without excessive fanning out of coupons 21 behind the first outer coupon 21'.

Low power drain is also accomplished by preventing buildup of excessive pressure between coupon remover 50 and coupon stack 40 and thus limiting the friction between subsequent layers of coupons 21 in coupon stack 40 and also lowering the rolling resistance between the top coupon and the take-off wheel 50. Accordingly, the mechanism 45 is mounted to pivot towards and away from stack 40 in response to pressure from stack 40.

The bracket 54, which is movably mounted to housing part 28 at pivots 58 supports the motor 46, the coupling 52 and coupon remover 50. A spring 56 urges coupon remover 50 toward coupon stack 40. Spring 56 is in compression between the bracket 54 and the control portion 28 of housing 24. The force exerted by spring 56 against coupon remover 50 is important as it sets a maximum permissible force between coupon remover 50 and coupon stack 40.

Bracket 54 rotates through a pivot path as shown by arrow 55 around pivots 58 connected into recesses in left or the control case portion 28 of housing 24. Other techniques for mounting and spring biasing bracket 54 may be used.

Regulation of the pressure between the coupon remover 50 and stack 40 is obtained by deriving the drive for a coupon stack advancer 60 from the coupon remover 50 through a releasable coupling such as clutch 64. The stack advancer 60 moves the coupon stack 40 along a stack path illustrated by arrow 61 toward coupon remover 50. Stack advancer 60 is in the form of a lead screw which is coupled by bevel gears 62 and clutch 64 to coupon remover 50.

The advantage of the stack pressure limitation achieved by-the invention can be appreciated from its operation. As coupon 21' is removed by the take-off wheel 50 clutch 64 causes rotation of lead screw 110 to move a push plate against the coupon stack 40. As the stack 40 advances towards wheel 50 pressure builds up until the bias from spring 56 is overcome and the clutch 64 is released to prevent further rotation of lead screw 110. The coupon remover 50 continues to remove coupons until the pressure from stack 40 again allows spring 56 to cause clutch 40 into engagement to rotate the lead screw 110.

Reliable coupon removal is achieved regardless of coupon thicknesses and any variations in forces that tend to retard motion of the stack towards the take-off wheel 50.

Referring now to FIGS. 2 to 5, gear train 52, coupon remover 50, and stack advancer 60 will be more specifically described Gear train 52 is formed of a special reducer section 79 formed with a pinion 82 on the output shaft 88 of motor 46 and reduction gears 84, 86 coupled to each other through pinion 85. A pinion 87 on the shaft of gear 86 engages a gear 80 on the shaft of take-off wheel 50 with some speed increase. Generally motor speed is reduced to provide sufficient torque to drive the take-off wheel 50 and rotate the lead screw 110.

Motor pinion 82 is attached to and actuated by output shaft 88 of motor 46. Motor 46 with its output shaft 88 and pinion 82 are mounted on bracket 54 so as to pivot with it in response to excessive stack pressure. Gears 84, 85, 86 and 87 are also affixed to bracket 54.

The take-off wheel 96 of coupon remover 50 has a shaft 98 of rotation that is aligned generally parallel to the surface of the first outer coupon 21'.

Take-off wheel 96 comprises a hub 100 and a relatively low durometer rubber O-ring 102 that is compliant in light of the low pressures used. O-ring 102 has a curved cross-section such that as pressure between take-off wheel 96 and coupon stack 40 is increased, the contact area between O-ring 102 and the first outer coupon 21' is also increased. In effect, this normally permits a relatively low torque and thus normally demands low battery power to remove the lead coupon 21'.

The contact area between the take-off wheel 50 and the top sheet 20' increases with increased pressure and with any retarding forces tending to prevent coupon removal. Hence, the contact area adapts to the amount of force required to move the coupon by virtue of the compliance of the O-ring 102.

Whenever motor 46 is actuated to rotate take-off wheel 96 its shaft 98 also rotates. This rotation is as shown by the arrow in a direction that tends to increase frictional coupling in the event resistance is encountered from lead screw 110. In its normal spring biased position, bracket 54 brings shaft 98 into frictional contact with the periphery of a drive or friction wheel 104 to rotate lead screw 110. However, when lead screw rotation causes excessive stack pressure, shaft 98 is lifted off drive wheel 104 and a clutch function is achieved. Further advance of stack 40 is then momentarily interrupted.

It is understood that mechanisms other than a lead screw may function in conjunction with drive wheel 104 and clutch 64 to advance stack 40 as described.

Drive wheel 104 is coaxially mounted with one of the meshing bevel gears 62 and both are supported by an arm 106 attached to base 42 of housing part 28. The other bevel gear 62 is coaxially mounted with lead screw 110 which is rotationally affixed to base 42.

Figure 6A:
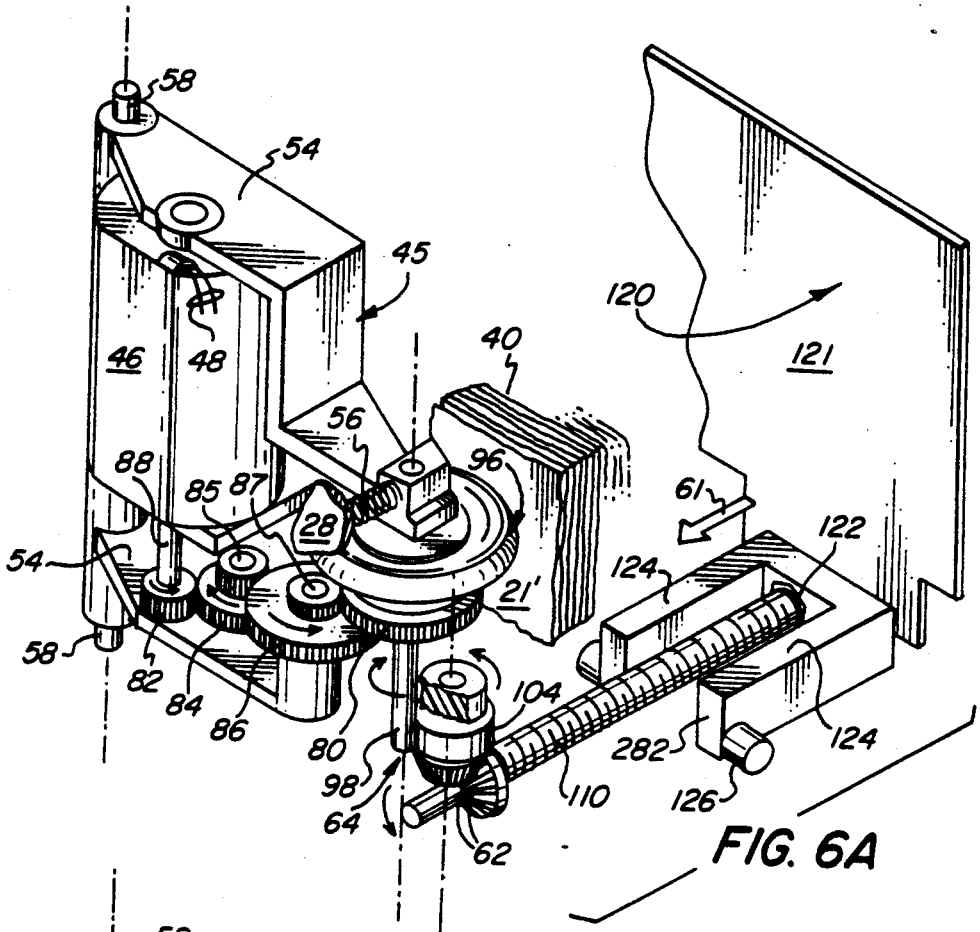
FIGS. 6A and 6B are enlarged partial perspective views of the coupon removing and stack advancing portions of the coupon dispenser of FIG. 1.
Figure 6B:
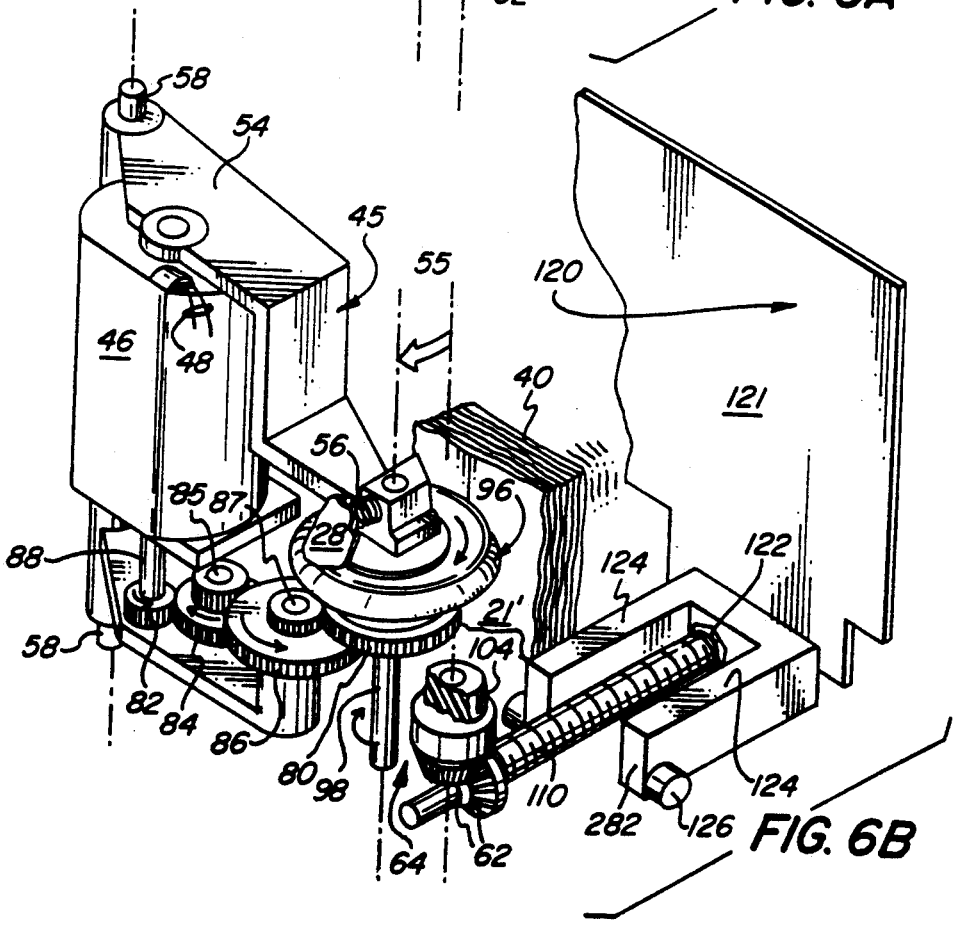
Figure 8D:
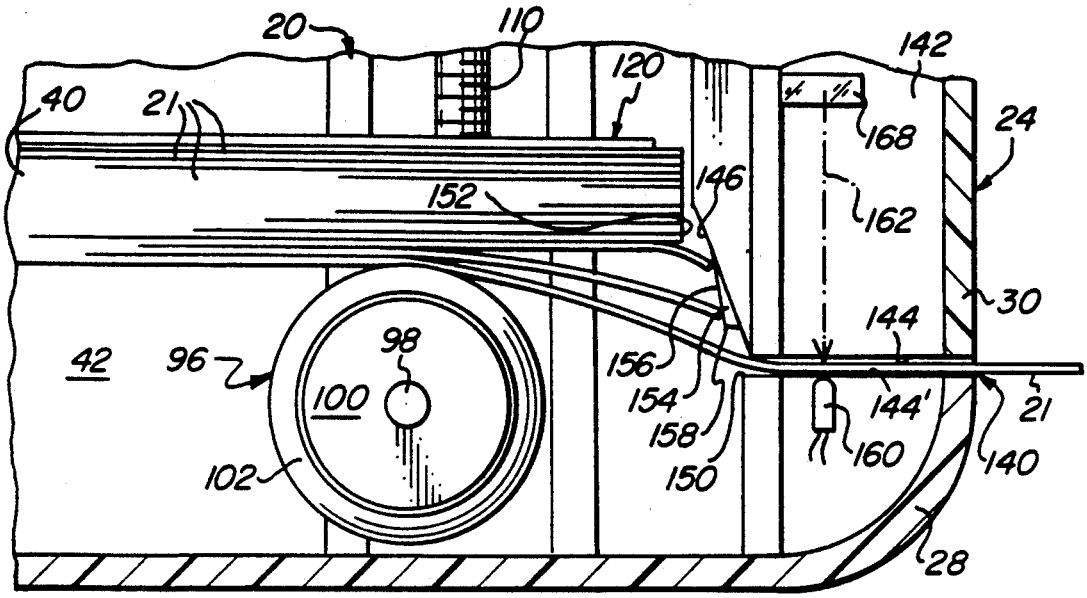
FIGS. 8A to 8D are top schematic views of the coupon dispenser of FIG. 1 depicting removal of a coupon from the stack.
Figure 7:
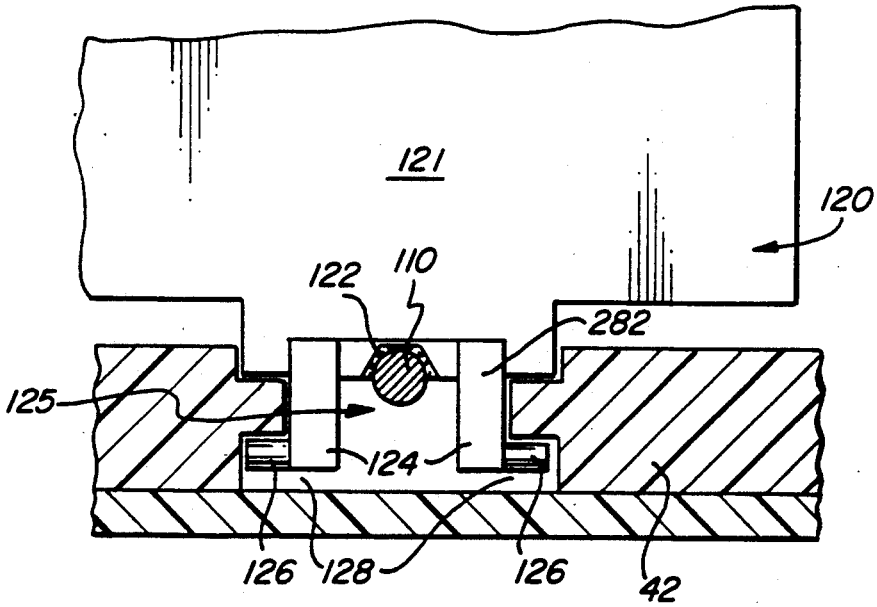
FIG. 7 is an enlarged partial side elevational view of the push plate of the coupon dispenser of FIG. 1.
Figure 8A:
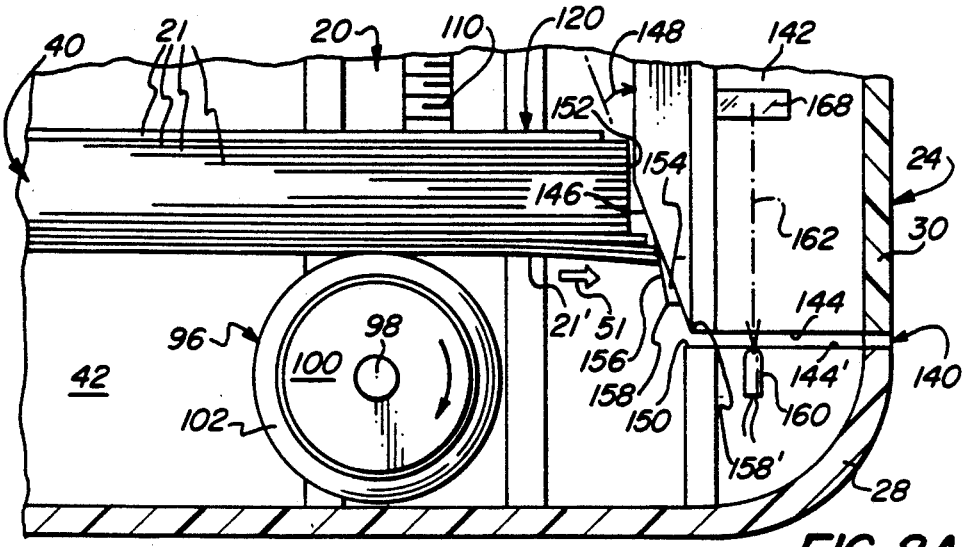
Figure 8B:
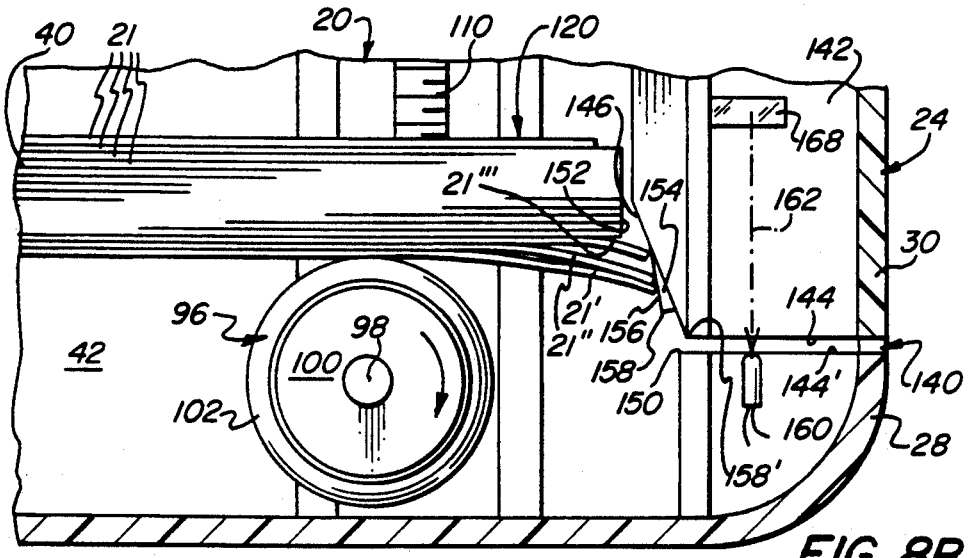
Figure 8C:
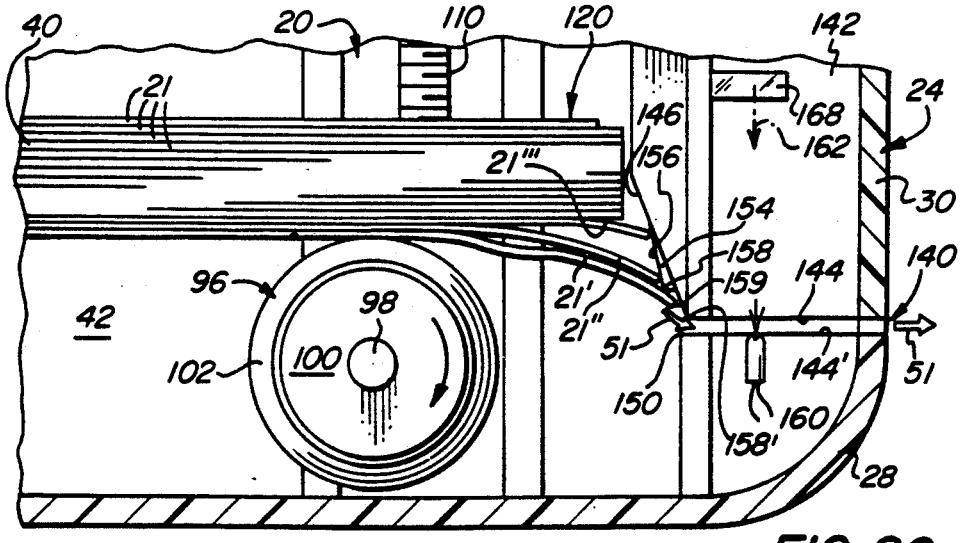

As previously mentioned, stack advancer 60 also comprises a push plate 120 that acts directly on stack 40 to move it to take-off wheel 96. As shown in the views of FIGS. 6A, 6B and 7, push plate 120 includes a stack support portion 121, a thread engaging element 122 and a follower element or guide segment 124.

Thread engaging element 122 meshes with the threads of lead screw 110 so that its rotation causes stack support portion 121 to push stack 40 along stack path 61 toward coupon remover 50. Element 122 is shaped to be lifted off lead screw 110 enabling push plate 120 to be retracted by then sliding it back to receive a new supply of coupons. Preferably, thread engaging element 122 is saddle shaped and covers an axial segment of lead screw 110 to engage one or preferably a multiple of threads.

Follower element 124 fits within and slides along a guide slot 125 formed in base 42 of housing 24 and which is aligned substantially parallel to lead screw 110.

Follower element 124 includes guide fingers 126 which extend outwardly therefrom and slide along guide channels 128 formed in the walls of guide slot 125. Fingers 126 function in conjunction with guide channels 128 to hold stack support portion 121 in threaded engagement with lead screw 110 even when coupon dispenser 20 is bumped or jostled as well as to permit the push plate to be pivoted up for retraction.

As shown in FIGS. 6A and 6B, the operation of clutch 64 is illustrated in detail. Shaft 98 is normally urged toward drive wheel 104 by spring 56 and when it engages drive wheel 104 causes advancement of coupon stack 40 along stack path 61 whenever take-off wheel 96 is rotated to remove the lead coupon 21'. When coupon stack 40 has been advanced so far as to apply excessive pressure to take-off wheel 96, causing further compression of spring 56, shaft 98 is moved away from drive wheel 104 to thus interrupt further advancement of coupon stack 40.

During normal operation shaft 98 moves back and forth for intermittent drive of wheel 104. Thus, gradually feeding new coupons to take-off wheel 96. The advance of the stack of coupons is assured by the high mechanical advantage provided by the screw thread on lead screw 110. As a result, a very consistent pressure on each coupon is obtained regardless of coupon thickness.

Since the clutch mechanism 64 is continually engaged and disengaged to maintain a preferred pressure between the take-off wheel 96 and coupon stack 40 reliable removal of coupons with a low current drain on batteries 34 is achieved. The clutch mechanism 64 operates in a feedback manner in that push plate 120 causes cessation of its own advance along stack path 61. The preferred pressure is selected depending upon factors such as the contact area of take-off wheel 96, and the thickness, size, and paper quality and the nature of the printing ink of coupons 21. Generally a force between take-off wheel 96 and the stack 40 in the range from about one ounce to about 5 ounces has been found sufficient for sheet sizes $2\frac{1}{4} \times 5$ inches, nominal.

When clutch 64 is engaged, coupon dispenser 20 is designed such that push plate 120 will be advanced preferably at least one and at times up to about five coupon thicknesses as take-off wheel 96 is rotated to dispense a coupon. It is understood that the actual number of coupon thicknesses which push plate 120 is advanced, during attempted removal of a coupon, may vary between about zero when clutch 64 is disengaged due to excessive stack pressure and about five when pressure between stack 40 and take-off wheel 96 is slack. In normal operation and with normal stack pressure, however, push plate 120 will be advanced about one coupon thickness with removal and dispensing of any one coupon.

In order that the dispensing of first outer coupon 21' is capable of advancing coupon stack 40 a given number of coupon thicknesses, factors such as the following should be considered: 1) the thickness of coupons 21, 2) the pitch of the threads of lead screw 110, 3) the average number of rotations of take-off wheel 96 necessary to dispense first outer coupon 21' a predetermined amount, 4) the respective circumferences of shaft 98 and drive wheel 104, and 5) the gear ratio of meshing bevel gears 62.

With reference to FIGS. 8A to 8D successive views during the removal of a coupon from coupon stack 40 are shown. Control portion 28 and hopper portion 30 of housing 24 are shaped so as to form a coupon discharge slit 140 at a front part 142 of housing 24 from which coupons 21 are dispensed and presented. Discharge slit 140 extends through housing 24 and is bound on both sides by slit walls 144, 144'.

Hopper portion 30 of housing 24 has an inner guide wall 146 which faces coupon stack 40 and lies across discharge path 51. Guide wall 146 extends with a deflection angle 148 towards discharge slit 140 and merges terminates at the slit wall 144. Control portion 28 of housing 24 comprises a turning surface 150 which is an extension of slit wall 144' opposite guide wall 146.

As coupons 21 are dispensed, their leading edges 152 impact guide wall 146 in response to rotation of take-off wheel 96. Upon impact, leading edges 152 are deflected along guide wall 146 toward turning surface 150 which then deflects them to discharge slit 140.

Because guide wall 146 normally does not by itself provide reliable separation of twinned coupons (i.e. the sticking together of a pair of coupons) (see FIG. 8A), guide wall 146 is preferably provided with a raised tab 154 having a separation surface 156 and a sharp tab edge 158. Separation surface 156 preferably has a slightly shallower or smaller deflection angle (for low motor power) than deflection angle 148 of guide wall 146. Guide wall 146 deflection angle 148 is sufficient to cause separation for normally fanned out coupons without creating unnecessary work for the motor. In some instances, tab 154 can have a separation surface with a more acute deflection angle than guide wall 146, but at the expense of more motor power.

Raised tab 154 functions to separate first outer coupon 21' either from "twinned" or entrained coupons 21'' which are stuck to first outer coupon 21', or from coupons 21''' fanned out from coupon stack 40 together with first outer coupon 21'. As twinned or fanned-out coupons impact separator surface 156 they are retarded and at least partially separated from first outer coupon 21' (see FIG. 8B). At least partial separation of twinned or fanned-out coupons is also accomplished at sharp tab edge 158 over which first outer coupon 21' drags as it is dispensed to scrape or peel away underlying coupons (see FIG. 8C). Additionally, a sharp corner 158' is employed to enhance separation of coupons in a similar manner as sharp edge 158. The combination of the relatively shallow deflection angle of separation surface 156 with sharp tab edge 158 provides reliable separation of first outer coupon 21' for dispensing through discharge slit 140 (see FIG. 8D).

As shown in FIG. 3, raised tab 154 has a length smaller than the length of the leading edges 152 of coupons 21. Preferably, the length of raised tab 154 is substantially smaller than the length of leading edges 152. This reduces the impact load on motor 46 and thus the additional power-drain that a full length tab would cause.

Raised tab 154 is shown in its preferred position generally near the top of leading edges 152. Returning now to FIG. 8C, as leading edges 152 drag over sharp tab edge 158, upper corner 159 of coupon 21' is slightly turned over. If necessary to effect reliable separation of first outer coupon 21', a second raised tab (not shown in any FIG.) may be placed on guide wall 146 below raised tab 154 generally near the bottom of leading edges 152. This second raised tab would perform the similar function of folding up a bottom corner of coupon 21' to further improve separation.

Also illustrated in FIGS. 8A to 8D is a coupon edge detector 160 provided by a light sensor 160 for sensing whether or not a coupon 21 is being dispensed. When no coupon 21 is dispensed, light sensor 160 senses light passed across discharge path 51 along passageway 162 (see FIGS. 8A to 8C and 5). When coupons 21 are dispensed, light sensor 160 produces a change in its output signal when light along passageway 162 is blocked by a coupon (see FIGS. 8D and 2) or unblocked.

As described below with reference to FIG. 9, detection of leading edges 152 provides a signal indicative of the positioning of a coupon for customer removal and the detection of a trailing edge provides a signal indicative of actual removal of a coupon by a customer.

Passageway 162 passes through slit walls 144, 144' of discharge slit 140 by a light pipe 164 (see FIG. 3) which can be a light guide rod but preferably is just a passageway. Light pipe 164 extends not only across discharge slit 140 through slit walls 144, 144' but also generally vertically through housing 24 and terminates at an aperture 166 in hopper portion 30 (see FIGS. 1 and 5). Aperture 166 is preferably located on an upward surface of housing 24 to receive as much ambient light as possible.

Ambient light, indicated by the arrows, is received in aperture 166 and follows a generally vertical portion of passageway 162 through light pipe 164 toward a prism 168 or other reflector or refractor. Prism 168 directs incoming ambient light further along passageway 162 through light pipe 164 toward light sensor 160 to be sensed or blocked by coupons 21. For applications where the ambient light is not adequate an independent light source is used.

Figure 9:
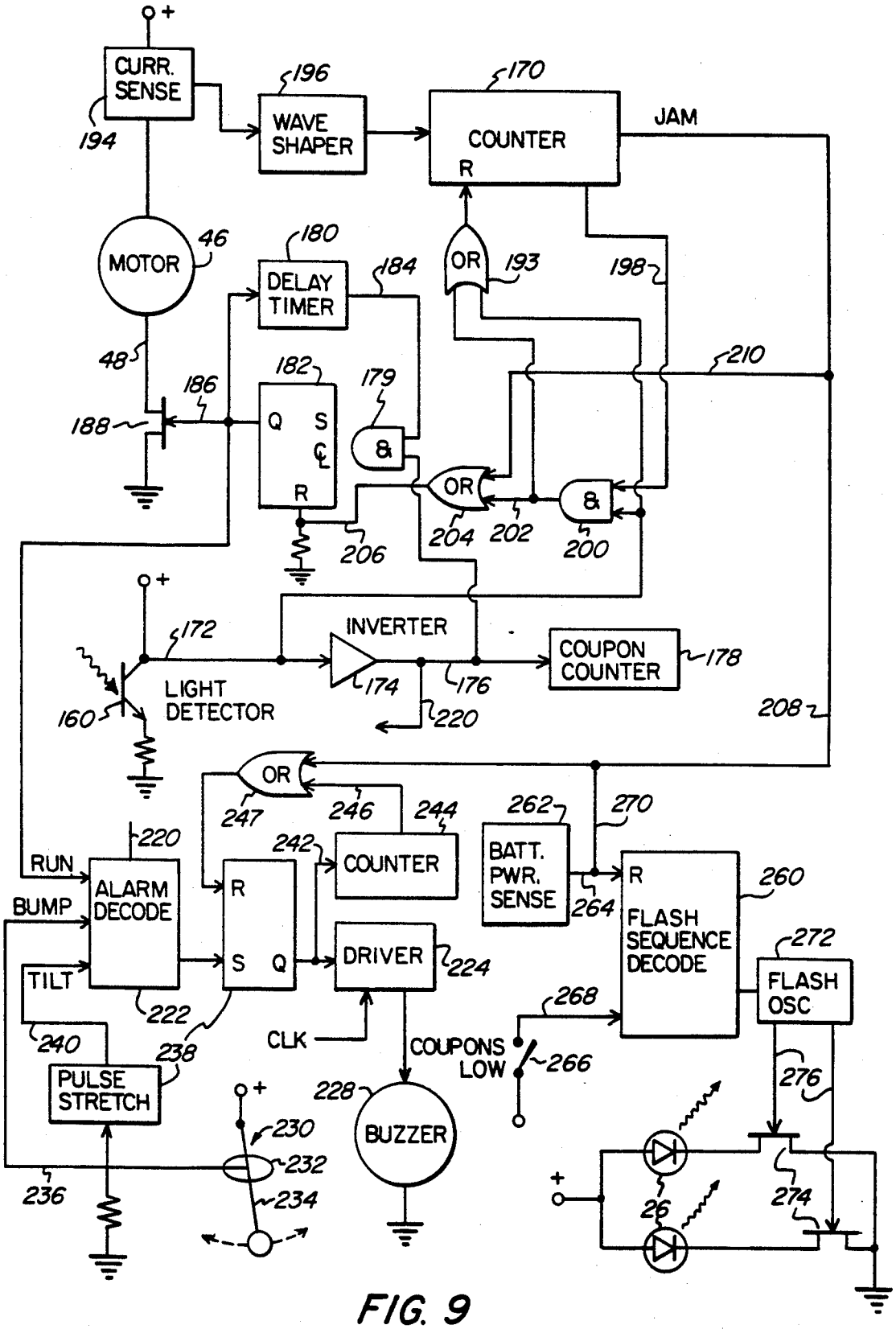
FIG. 9 is a block diagram of the circuitry for the coupon dispenser of FIG. 1.
Figure 11:
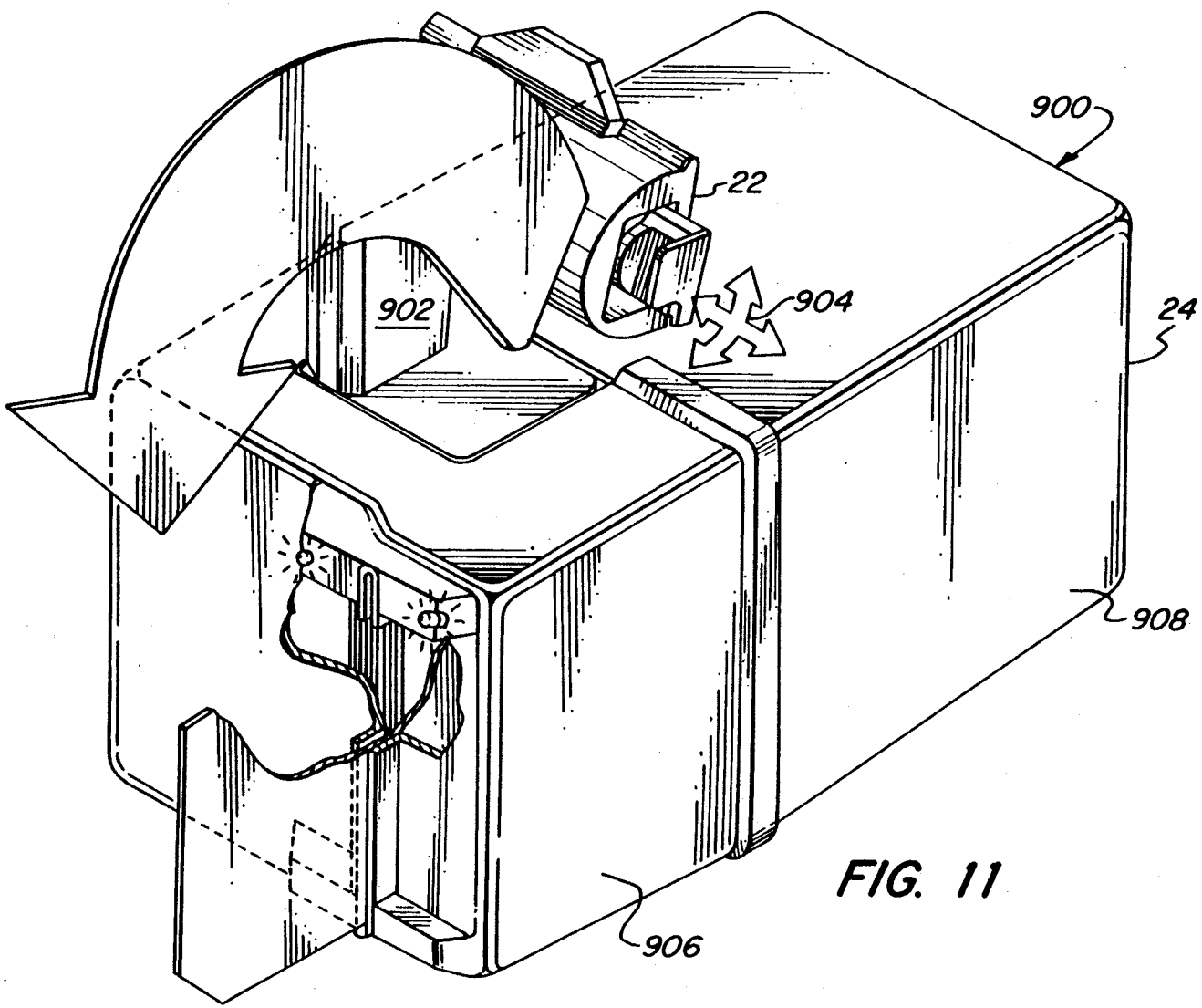
FIG. 11 is a front perspective view of another embodiment of a coupon dispenser in accordance with this invention.

FIG. 9 is a block diagram of the circuitry of coupon dispenser 20 on printed circuit board 170 (not shown in this FIG., see FIGS. 2–4 and 10) affixed to control portion 28 of housing 24.

A trigger element is used in the circuit in the form of light sensor 160, whose output signal is provided on line 172 to indicate transitions from no light received to light received and vice versa.

During normal operation of coupon dispenser 20, such transitions occur upon initial passage of a coupon and subsequent removal of a coupon 21 by a customer as described above with reference to FIGS. 8A to 8D. At initialization, a similar transition can be effected by first covering and then uncovering light aperture 166 on housing 24.

When the previously presented coupon is first removed its trailing is detected when light is received at light sensor 160. The signal on line 172 is pulled low causing the signal on line 176 to go high due to inverter 174. The inverted signal is passed to both a coupon counter 178 and an AND gate 179 whose output is coupled to the clock input of flip-flop 182. This causes its Q output to close switch 188 to start motor 46 to start coupon ejection.

The leading edge of a coupon breaks the light beam causing line 172 to go high. This resets counter 190 via OR gate 193 and enables AND gate 200. Motor 46 continues to run and its tachometer (commutating pulses from current senser 194) output continues to increment counter 190.

When a preset number of counts have occurred an output occurs on line 198 to trigger AND gate 200 and cause a reset of flip-flop 182 through OR gate 204. This stops the motor via switch 188. This achieves the desired fixed coupon ejection length while eliminating the effects of any wheel slip on initial motor startup.

Coupon counter 178 preferably provides both a count of coupons dispensed since last reload, and/or last reset of the counter. The coupon count is useful in determining whether coupon dispenser 20 is advantageously placed from a marketing perspective.

While the above is accomplished the delay timer 180 is activated. Its output removes the enabling signal from AND gate 179 which disables further clock inputs to flip-flop 182 for a preset time period.

The current sensor 194, wave shaper 196 and counter 190 may be a circuit as described, for example, in U.S. Pat. No. 3,346,725 to Allured et al. the disclosure of which is incorporated herein by reference thereto, revolutions of motor 46 are sensed by a current sensing device 194, shaped by a wave shaping circuit 196, and then counted by counter 190.

By counting the revolutions of motor 46 after first detecting leading edges 152 of coupons 21, coupons 21 are more reliably dispensed because of less sensitivity to supply voltage variations, and may effectively be dispensed the same distance each time. This is because any slippage of take-off wheel 96 in separating a coupon 21 from coupon stack 40 is eliminated from the motor revolution count and thus the distance that a coupon 21 is dispensed.

If leading edges 152 of coupons 21 are not detected after a predetermined number of revolutions of motor 146, i.e. counter 190 fails to be reset, counter 190 overflows and a JAM or SHUTDOWN signal is passed along lines 208 and 210 through OR gate 204 and along line 206 to reset flip-flop 182 and turn motor 46 OFF as described above and turn off the entire coupon dispenser 20 through OR gate 247.

When customers remove coupons 21 from coupon dispenser 20, they are "rewarded" with a beep. This beep also serves to pique the curiosity of additional customers in removing, and hopefully using, a coupon 21. The reward beep is issued by passing the inverted signal on line 176 along line 220 to an alarm decoder 222 which instructs driver 224 along line 226 to issue a gentle beep from buzzer 228.

Additional inputs to alarm decoder 222 are provided by a housing level sensor 230 which, though not shown in the other FIGS., is mounted directly to printed circuit board 170. Housing level sensor 230 may be provided as a hoop 232 and a pendulum 234. A signal indicative of contact between hoop 232 and pendulum 234 is passed along line 236 to alarm decoder 222 for issuance of a beep or buzz sound. This is preferably louder and less gentle than the reward beep, signifying that coupon dispenser 20 has been bumped or jostled This bump beep assists in preventing tampering with coupon dispenser 20.

The bump signal on line 236 is also passed to a timer 238 which, after the presence for a continuous predetermined period of a signal representative that the housing 24 is not level, issues a tilt signal along line 240 to alarm decoder 222. Upon receipt of a tilt signal, alarm decoder 222 instructs driver 224 along line 226 to issue loud repetitive beeps signifying that someone may be attempting to steal or tamper with coupon dispenser 20.

Instruction signals on line 236, whether for rewards, bumps or tilts, are also passed along line 242 to a counter 244. If counter 244 records a predetermined excessive number of beep instructions for a given period of time, alarm decoder 222 is RESET along line 246 and coupon dispenser 20 is shutdown as may also happen when a jam condition occurs on line 248. It is understood that coupon dispenser 20 may also be made to shutdown if too many coupons 21 are removed therefrom in a given period of time even though no jam condition occurs.

Flashing light sequence generator (flash decoder) 260 receives inputs from a battery power sensor 262 along line 264, a low coupon level indicating switch 266 along line 268, and the jam or shutdown condition signal along line 270. Normally, flash decoder 260 instructs flash oscillator 272 along line 273 to continuously flash lights 26 (see FIGS. 1, 4 and 5) by turning switches 274 ON and OFF along lines 276 at a predetermined frequency.

When battery power sensor 262 determines that batteries 34 (see FIGS. 2, 4 and 10) are running low, flash decoder 260 alters the frequency of flash oscillator 272 to provide a visual indication that a service call will soon be necessary to replace batteries 34.

Figure 4:
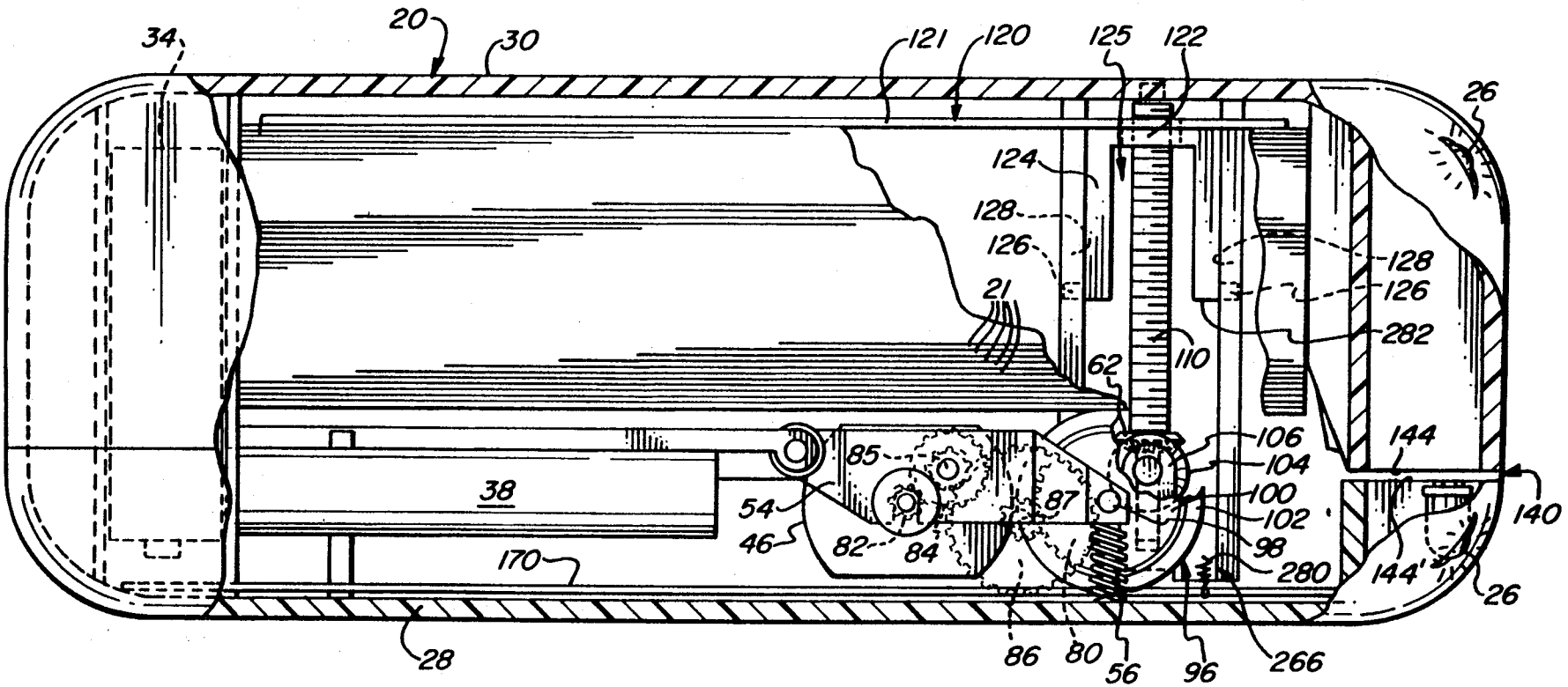
FIG. 4 is a top plan view of the coupon dispenser of FIG. 1.

Referring briefly to FIG. 4, a low coupon level sensing switch 266 may, for example, comprise a spring 80 mounted to printed circuit board 170 for actuation by a front edge 282 of guide element 124 of push plate 120. Upon actuation of switch 266, a visual indication that a service call to insert more coupons in the hopper will soon be necessary is provided as described above.

Figure 10:
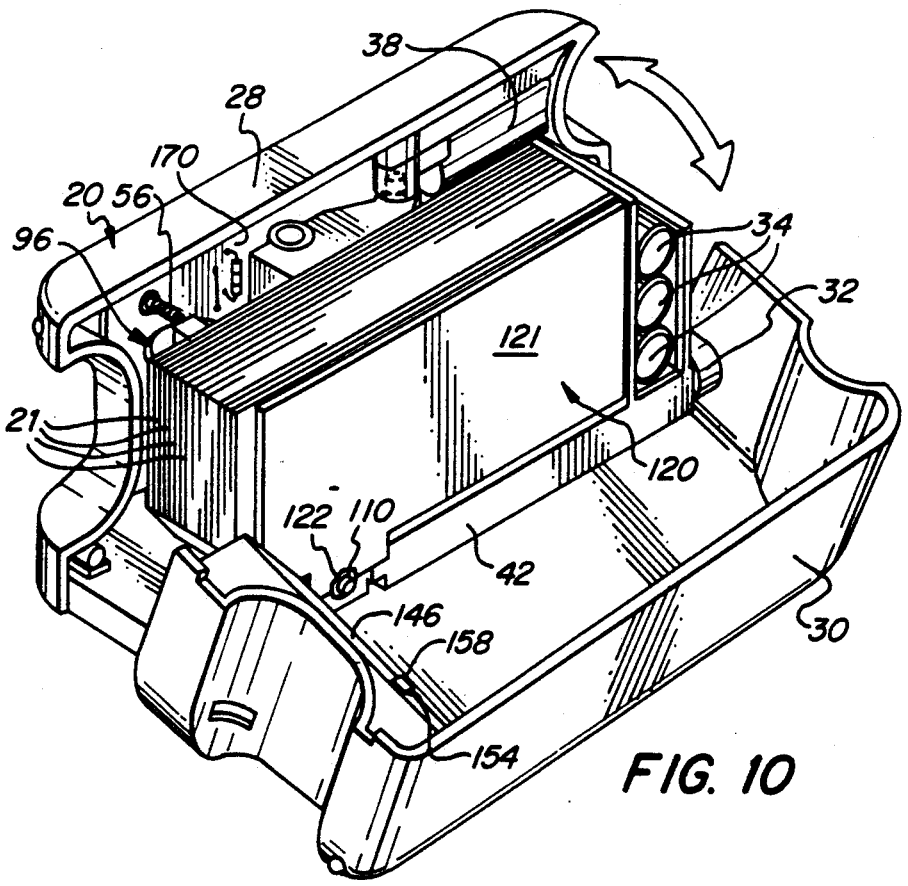
FIG. 10 is a reduced front perspective view of the coupon dispenser of FIG. 1 with the case open for servicing.

Referring now to FIG. 10, hopper portion 30 of housing 24 can be rotated about hinge 32 with respect to control portion 28 of housing 24, as shown by the arrow, to longitudinally open housing 24. In this manner, routine servicing such as replenishment of coupons 21 and replacement of batteries 34, and other maintenance may be completed.

FIGS. 11 to 14 illustrate another embodiment of a coupon dispenser 900 in accordance with this invention. Only substantial differences between embodiments 20 and 900 of the coupon dispenser will be described with reference to these FIGS. in which substantially similar parts are numbered the same.

Mounting device 22 is attached on top of coupon dispenser 900 via a bracket 902. Bracket 902 permits up and down, and side to side rotational placement, as indicated by arrow 904, of mounting device 22, enabling rotational mounting of coupon dispenser 900. Housing 24 of coupon dispenser 900 alternatively comprises a front portion or cap 906 and a rear portion 908.

Figure 12:
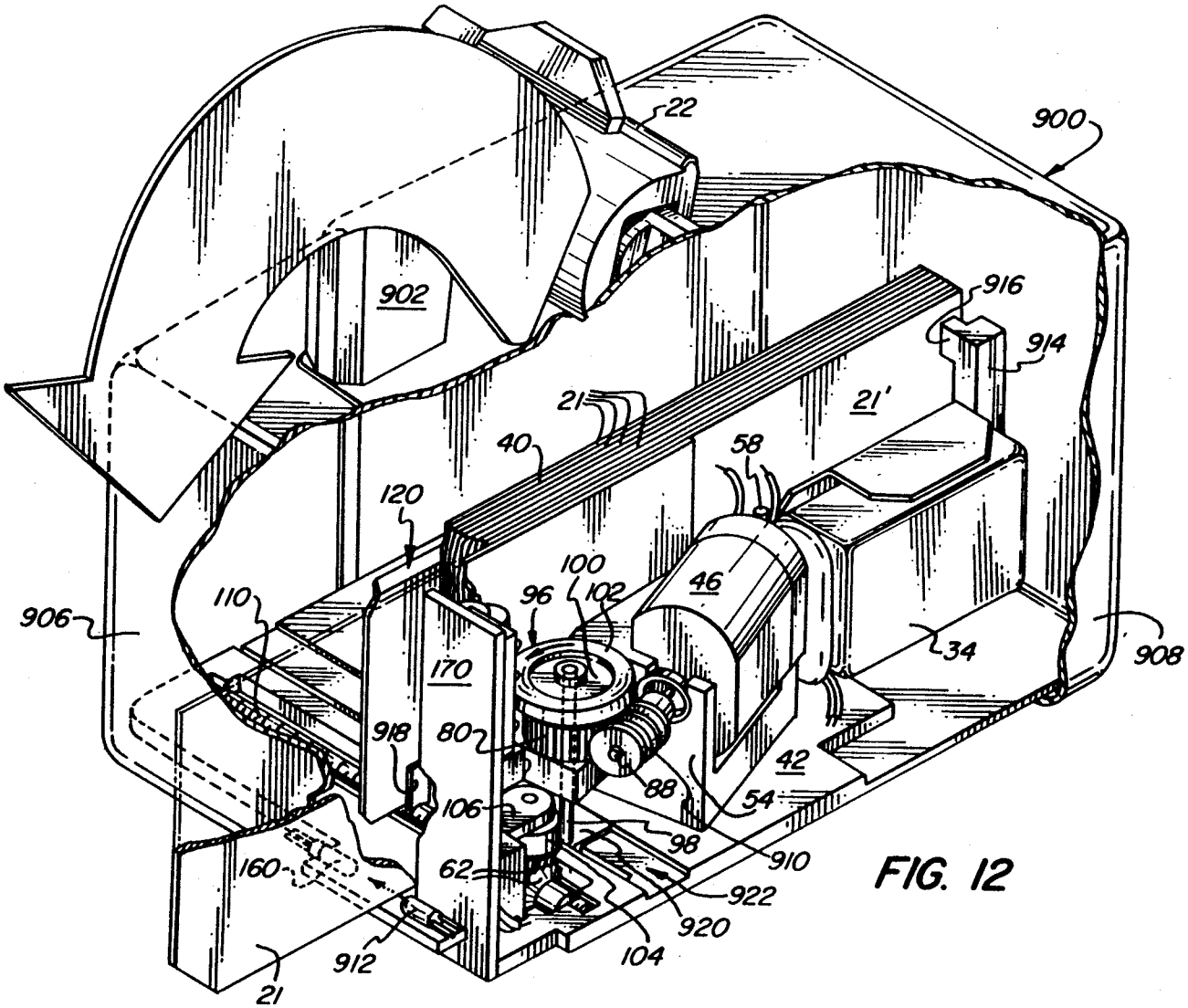
FIG. 12 is a partially cut away front perspective view of the coupon dispenser of FIG. 11.

Referring now to FIG. 12, differences in the structure and inner workings of coupon dispenser 900 are revealed. Rather than a gear train, coupon remover pinion 80 is rotated by a worm gear 910 affixed to rotate with output shaft 88 of motor 46. Also, instead of utilizing ambient light to trigger detector 160, a light emitting diode 912 is utilized. Although light emitting diode 912 is less power efficient than ambient light, some power savings can be achieved by pulsing diode 912.

A post 914 having a protuberance 916 aids in the separation of a single coupon 21 from coupon stack 40 in the following manner. As first outer coupon 21' begins to slide from coupon stack 40, it need only move a short distance before it is free from the pressure applied by protuberance 916. Underlying coupons 21, however, remain subject to this pressure permitting first outer coupon 21' to be more easily removed.

Figure 13A:
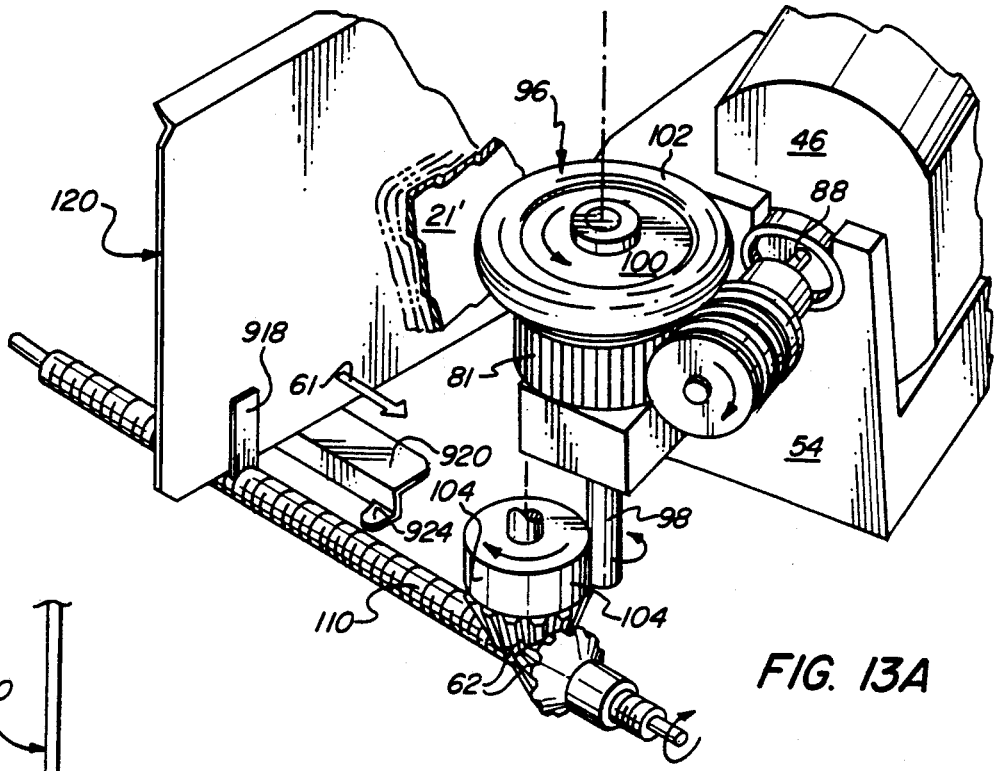
FIGS. 13A and 13B are enlarged partial perspective views of the coupon removing and stack advancing portions of the coupon dispenser of FIG. 11.
Figure 14:
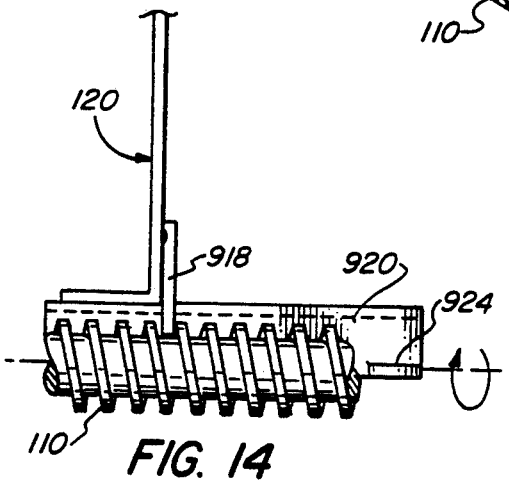
FIG. 14 is an enlarged partial front elevational view of the push plate of the coupon dispenser of FIG. 11.
Figure 13B:
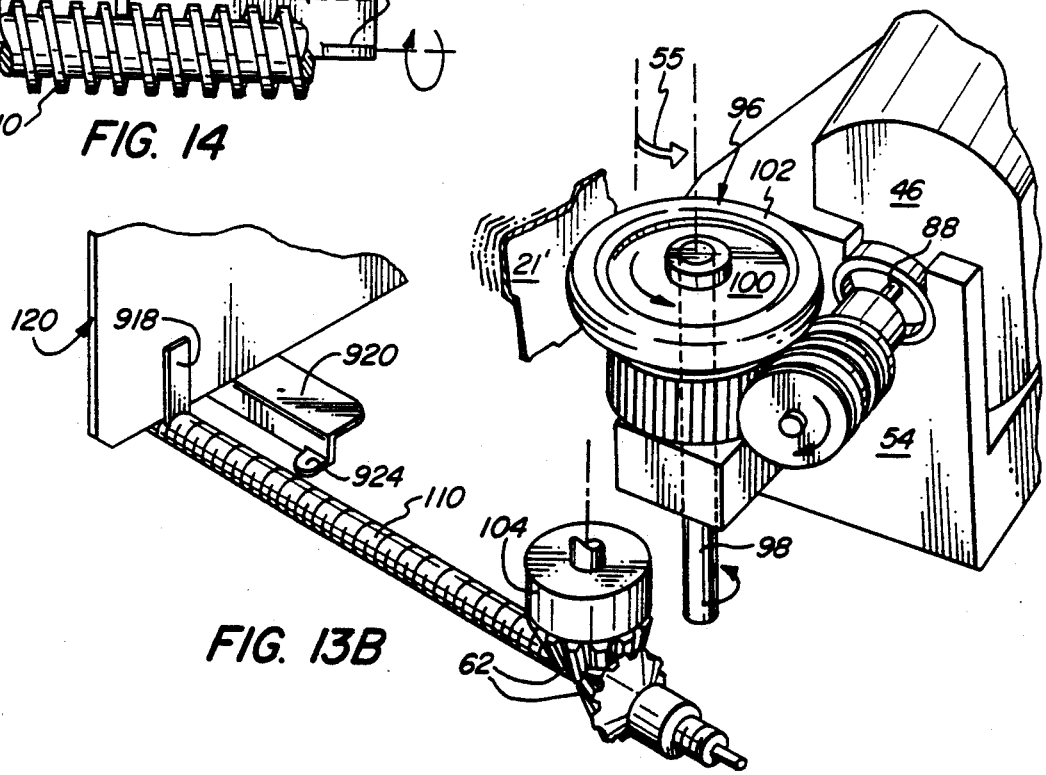

Referring now to FIGS. 13A to 14, a slightly different design of push plate 120 is illustrated. A thread engaging tab 918 rides along a single thread of lead screw 110. Further, a slightly different guide element 920 follows along a matching guide slot 922 (see FIG. 12). An inwardly extending finger 924 is also included.

Although the invention has been described with reference to particular embodiments, features and the like, these are not intended to exhaust all possible features, and indeed many other modifications and variations will be ascertainable to those of skill in the art.

What is claimed is:

1. A coupon dispenser, comprising:

a housing having a coupon hopper to store a stack of coupons and a discharge slit from which dispensed coupons are presented;

coupon remover means for dispensing coupons from one side of the stack of coupons along a discharge path towards the discharge slit;

stack advancing means for moving said stack of coupons towards said coupon remover means;

motor means for actuating said coupon remover means and said stack advancing means;

a clutch interposed between the stack advancer means and the motor means for disengaging said motor means from said stack advancer means when it applies excessive pressure against said coupon remover means;

means for detecting an edge of a coupon as it is being dispensed and producing an edge signal indicative thereof; and means responsive to the edge signal for deactivating the motor means after it has dispensed a coupon a desired distance from the discharge slit.

2. The coupon dispenser as claimed in claim 1 wherein said edge-detecting means comprises a light sensor oriented to detect light directed across the discharge path.

3. The coupon dispenser as claimed in claim 2 wherein said edge detecting means further comprises a light pipe extending through said housing to receive ambient ceiling light and direct it across said discharge path.

4. The coupon dispenser as claimed in claim 3 wherein said light pipe has a light reflector positioned to reflect received ambient ceiling light towards the light sensor.

5. The coupon dispenser as claimed in claim 2 wherein said edge detecting means detects trailing edges of coupons as these are withdrawn from the housing to produce a trailing edge signal indicative thereof; and means responsive to the trailing edge signal for activating said motor means a predetermined time after detection of the trailing edge signal.

6. The coupon dispenser as claimed in claim 5 and further comprising:

means in said housing for generating an alarm;

means for detecting a failure to detect a leading coupon edge after detection of a trailing edge of generating an alarm signal indicative thereof; and means responsive to said alarm signal for producing an alarm.

7. A coupon dispenser comprising:

a housing having a coupon hopper to store a stack of coupons and a discharge slit from which dispensed coupons are presented;

coupon remover means for dispensing coupons from one side of the stack of coupons along a discharge path towards the discharge slit;

stack advancing means for moving said stack of coupons towards said coupon remover means;

motor means for actuating said coupon remover means to dispense a coupon;

means for detecting a leading edge of a dispensed coupon for generating a leading edge signal indicative thereof;

means for applying the leading edge signal to deactivate said motor means after the coupon has been dispensed a desired distance from the discharge slit;

means for detecting an edge of a coupon as it is being removed from the housing and producing an edge signal indicative thereof; and means responsive to the edge signal for reactivating the motor means a desired time after the coupon has been removed from the housing.

8. A method of dispensing coupons from a coupon dispenser for a project at the point of sale of the product to as many different persons as possible, comprising the steps of:

dispensing a coupon from a coupon stack to a dispensing position;

awaiting removal of the coupon from the dispensing position by a person;

sensing removal of the coupon from the dispensing position;

after sensing removal of the coupon, sensing movement in an area adjacent the coupon dispenser;

after sensing both removal and movement, triggering a time delay of predetermined duration; and then dispensing another coupon from the coupon stack to the dispensing position.

* * * * *